United States Patent [19]

Baltzer

[11] Patent Number: 4,765,041

[45] Date of Patent: Aug. 23, 1988

[54] APPARATUS FOR THE PRODUCTION OF SHORT WARPS ESPECIALLY FOR CLOTH DESIGNS IN MULTICOLOR WEAVING

[75] Inventor: Erich Baltzer, Nordhorn, Fed. Rep. of Germany

[73] Assignee: Hergeth Hollingsworth GmbH, Fed. Rep. of Germany

[21] Appl. No.: 891,963

[22] Filed: Jul. 15, 1986

Related U.S. Application Data

[63] Continuation of Ser. No. 581,041, Feb. 17, 1984, abandoned.

[30] Foreign Application Priority Data

Mar. 2, 1983 [DE] Fed. Rep. of Germany ..... 3307301

[51] Int. Cl.[4] ..... D02H 9/02

[52] U.S. Cl. ..... 28/191; 28/198

[58] Field of Search ..... 28/191, 198, 199

[56] References Cited

FOREIGN PATENT DOCUMENTS 757787 4/1971 Belgium ..... 28/191

45-21259 7/1970 Japan ..... 28/198

47-46859 11/1972 Japan ..... 28/198

47-46860 11/1972 Japan ..... 28/198

48-3653 2/1973 Japan ..... 28/198

909497 10/1962 United Kingdom ..... 28/198

*Primary Examiner*—Robert R. Mackey

*Attorney, Agent, or Firm*—Diller, Ramik & Wight

[57] ABSTRACT

In apparatus for the production of short warps, yarns of different color are consecutively wound up while traversing yarn crossing means. A drum having a conically ascending initial portion is provided as a winding body, while lease rods and an overrun rod are displaceably fitted along the drum axis. A support (18) displaceable along the drum axis includes a thread guide means and a heald frame (24) for shedding. In addition to the lease rods (4,5) serving for the formation of yarn crossings, the warping drum comprises further lease rods (5) for the preparation of yarn divisions (86). As for the heald frame (24), it comprises in addition to the two shafts for the yarn crossing formation, further shafts (27*a,b,c* . . . ) of a number of corresponding to the yarn divisions of the yarn package.

15 Claims, 8 Drawing Sheets

APPARATUS FOR THE PRODUCTION OF SHORT WARPS ESPECIALLY FOR CLOTH DESIGNS IN MULTICOLOR WEAVING

CROSS-REFERENCE TO RELATED APPLICATIONS

This application is a continuation of application Ser. No. 581,041 filed on Feb. 17, 1984, now abandoned, in the name of Erich Baltzer.

BACKGROUND OF THE INVENTION

The invention relates to an apparatus for the production of short warps, in particular for cloth designs in multicolor weaving, comprising winding up successively yarns of different colors which yarns, while being wound up, are traversing crossing means, it being possible to cut open transversely the yarn sheet obtained as an endless yarn sheet band.

It has been known to design the apparatus in such a way that the winding body is a drum having a conically ascending initial portion while lease rods and an overrun rod are provided displaceably along the drum axis. The system includes additionally a support having a thread guiding means and being displaceable along the drum axis, and a heald frame for shedding the yarn warp. Moreover, the apparatus comprises a control mechanism for the intermittent rotation of the drum from lease rod to lease rod and for a number of rotations subject to the desired warp length. A typical apparatus of this design is disclosed in Applicant's copending application Ser. No. 582,042 filed on Feb. 21, 1984, now abandoned and refiled as a continuation application on July 3, 1986 and assigned Ser. No. 881,664 and now U.S. Pat. No. 4,683,625 granted Aug. 4, 1987.

With a warp of a predetermined length, there is formed at least one yarn crossing mainly at the end of the warp, i.e. after the warp has been placed over the overrun rod which defines the point for cutting open the warp to obtain individual warp lengths. It is also possible to establish a yarn crossing shortly before the end of the piece length of the warp. The drum carrying the sucessively applied packages of the warp of predetermined lengths is conveyed to a rebeaming device to unwind the warp from the warping drum to a warp beam, the warp being impregnated with a sizing agent during the rebeaming operation. In case of dense and long warps, there is the risk for the yarns to mutually adhere by the sizing agent. To do away with said risk, the warp is divided during the rebeaming operation from the drum to the warp beam. In other words, the yarns of the warp situated side by side are caused to extend alternatingly over and beneath the lease rod which is to be used on the beaming machine. This is a very troublesome, complicated and time taking manipulation. During the rebeaming of the warp from the drum to the warp beam, the lease rod or several lease rods introduced manually are retained and slightly reciprocrated axially. Such yarn divisions which are only meant to keep apart adjacent yarns for the sizing operation, i.e. for the impregnation of the warps with the sizing agent, are also called sizing division. To this end, the yarns are not crossed, but only kept apart to ensure a sufficient wetting by means of the sizing agent, on the one hand, and to realize a safe and quick drying, on the other hand, without causing a mutual bonding of the threads or yarns arranged side by side.

SUMMARY OF THE INVENTION

It is the object of the invention to perform with the apparatus for the production of short warps of the above mentioned type also thread or yarn divisions, i.e. sizing divisions, during the warping of the yarn warp so as to permit to carry out automatically yarn divsisions with the warping apparatus.

The invention is characterized in that the warping drum comprises in addition to the lease rods serving for the formation of yarn crossings, other lease rods serving for the realisation of yarn divisions, and that the heald frames comprise in addition to the two shafts for shedding, to obtain yarn crossings, several further shafts of a number corresponding to the yarn divisions provided at the yarn package during the warping operation.

Due to such a warping apparatus design, it is possible to realize with the yarn packages of the warp of predetermined length, yarn divisions, i.e. sizing divisions of the desired number, and to also benefit from the automatic operation which is provided for the production of the yarn crossings. Taken in all, the warping operation and the subsequent rebeaming operation are considerably simplified, and the exact production of yarn divisions is ensured more safely. Moreover, time is saved, and expenditure is reduced as compared to the arrangement of yarn divisions to be performed additionally by mechanical means in case of the rebeaming device. Last off, yarn crossings and yarn divisions within a package determining the length of the warp are obtained more reliably.

As for the sizing division, a central division followed by a lower and an upper division are often carried out by using one lease rod for each division. It is quite advantageous to use the second lease rod of a preceding yarn crossing at the start of the warp to also apply it as a lease rod for the central division of the warp. One lease rod will be saved this way accordingly.

According to an additional feature of the invention, a cam means for the lease rods having an independent drive means is arranged at the support, it being possible for the cam means to include an abutment device to limit the stroke of the cam. Thus, to displace the cam means in longitudinal direction of the drum, the support need not be displaced, but it can be reciprocated by a spindle drive to be only shifted substantially along the drum axis during the transition from the finished package to a subsequent new package. The independent drive for the cam means is less involved and favorably includes a piston-cylinder-unit, e.g. a compressed air cylinder. The shifting movement of the cam means can be performed quickly, i.e. suddenly to accelerate the total operation. The same applies substantially to the abutment device which may be also operated by independent lifting cylinders.

It is appropriate to mount the holding elements for the cam means and the abutment device at a post to be arranged in spaced relationship to the support and firmly joined to the latter. Thus, the mentioned appliances can be provided to be well visible and easily accessible.

The invention will be now explained in more detail by means of a preferred embodiment illustrated in the drawings.

DESCRIPTION OF THE PREFERRED EMBODIMENT

Figure 3:
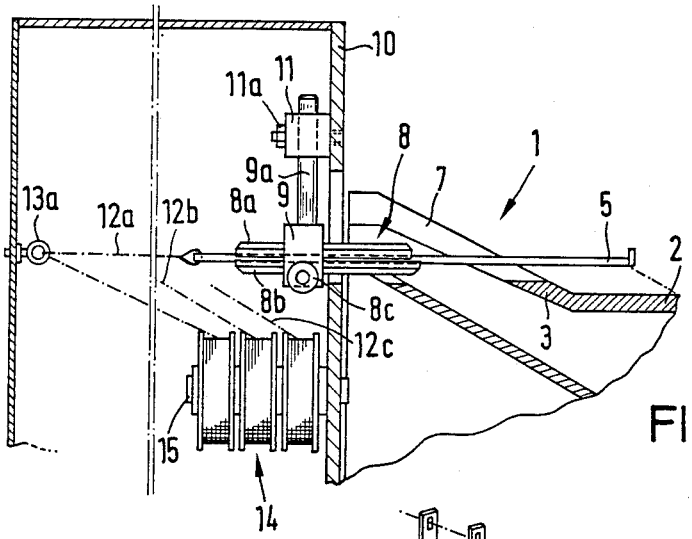
FIG. 3 is a schematic cross section of an embodiment showing the provision of a lease rod at the mounting for the cone drum.

The warping apparatus 1 for the production of short warps comprises as a winding body a drum 2 having an initial portion 3 ascending conically, lease rods 4 situated at the drum circumference, and additional lease rods 5 located at a distance from the periphery of the cylindrical drum 2 all such rods being longitudinally displaceable. As evident from FIG. 3, the cone portion 3 of the drum 2 may be provided with a predetermined number of slots 7. Each lease rod is supported by a guide 8 formed by the clamping jaws 8*a* and 8*b* which are held in interconnected relationship by the clamping screw 8*c*. The mounting 9 for the clamping unit contains slotted guide rods 9*a* which can be displaced radially of the mounting 10 fitted in the jack 11 stationarily arranged at the mounting 10, and which can be clamped by screw 11*a*. Each of the lease rods is fitted with a cord 12*a,b,c* guided about an eye 13*a,b,c* to the associated bobbin 14 to be held there in store. The set of bobbins 14 is positioned on a mandrel 15.

Figure 4:
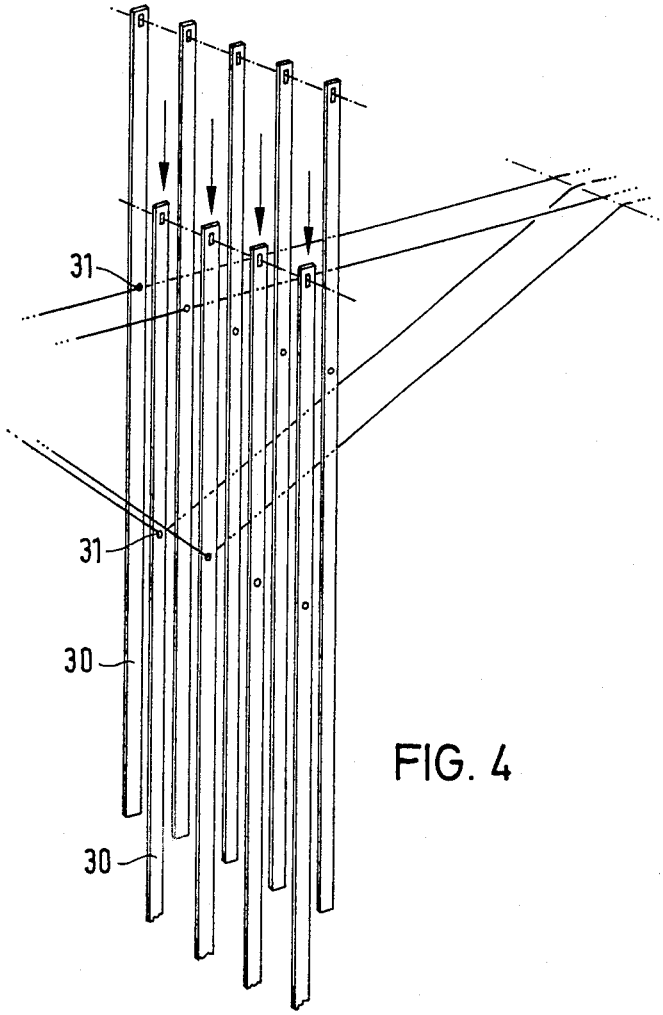
FIG. 4 is a schematic view of the construction of a shaft in the heald frame with the respective yarns.

A support 18 in the form of a frame-shaped yoke is displaceably propped at both ends on guides 19 along the axis of the shaft 20 on which the drum may be slipped and locked, the feed movement being effected by a threaded spindle 21 with lock. A heald frame 24 is secured by means of bolts 25, e.g. through two brackets 23, to the support 18, the heald frame 24 consisting e.g. of a U-shaped frame 26 containing in displaceable arrangement a number of shafts 27*a,b,c,d*. Each shaft 27 may include two laterally provided legs interconnected rigidly by cross bars 28 between which rails 29 are mounted for the displaceable arrangement of an optional number of flat steel strands 30. (FIGS. 1 and 4) Through eyes 31 of the latter, one cord of the respective yarn sheet 32 is conducted. To each shaft 27*a,b,c,d*, an actuating means, preferably a compressed air cylinder 33, is associated to set via a piston rod 34 the predetermined stroke height of the coordinated shaft.

The yarn sheet 32 required for a package which may contain one or more pattern repeats extends from a creel via a swivable compensating device or cylinder 35 to the heald frame 24. The compensating cylinder 35 is hinged between two transverse brackets 36 which are connected to the heald frame 24. The total number of yarns of the yarn sheet 32 is divided in conformity with the number of shafts 27*a,b,c,d*, e.g. with a hundred yarns and four shafts, there are twenty-five yarns per shaft. Subject to the desired yarn density in the warp, the yarns are conducted through a warping reed 38 (FIG. 2) to be secured to the warping drum 2, the warping reed 38 being displaceably fixed in a mounting 39 (FIG. 1) which is firmly connected to the yoke 18.

Figure 15:
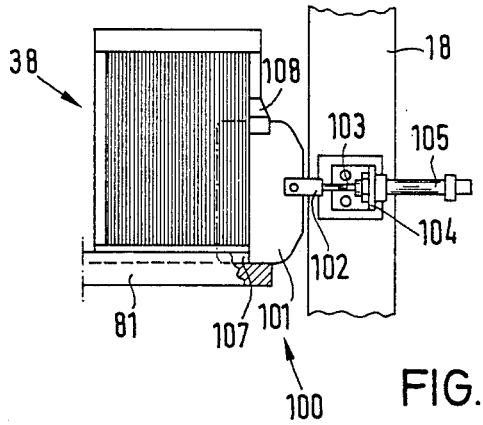
Figure 16:
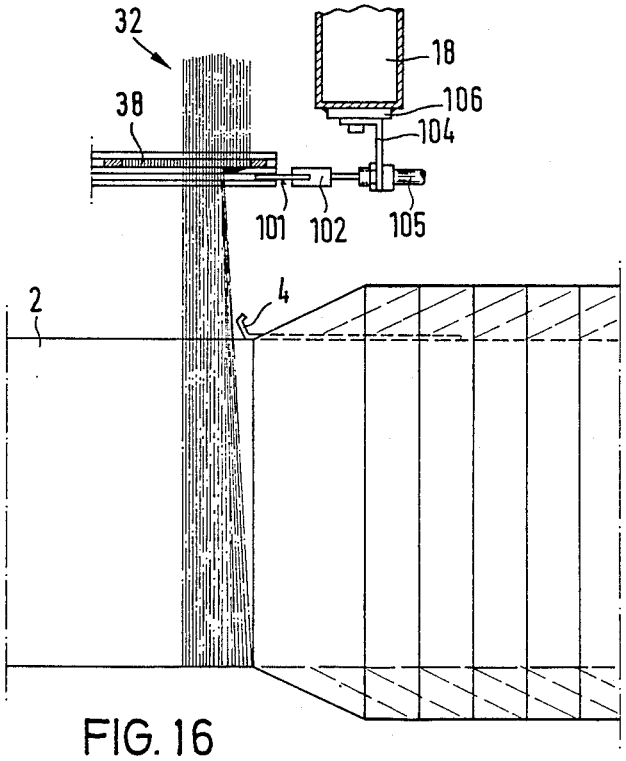

A sliding means 100 (FIGS. 15, 16) is provided between the warping drum 2 and the warping reed 38 to deviate the yarn sheet 32 so that a lease rod 4, when passing by, is not overrun by the yarn sheet 32. The sliding means 100 substantially consists of a slide 101, firmly connected via a fork head 102 to the piston rod 103 of a compressed air cylinder 105 disposed in a holder 104, mounted at the support 18 by means of a reinforcing plate 106. The slide 101 may be provided displaceably in a groove 107 of the mounting 39, its upper end being guided in a rail 108 which is firmly connected to the frame of the warping reed 38. The operation of the compressed air cylinder 105 may be performed by means of a magnetic valve with the aid of the program control means.

A cam means 41 (FIGS. 2 and 7) is provided to draw the lease rods 4 or 5 through a divided yarn sheet 32*a*, 32*b*. An angular plate 42 (FIGS. 1, 7 and 8) serving as a cam is connected to a guide bar 43 which is displaceably mounted in a holder 44 to which a compressed air cylinder 45 is secured by means of a nut (not shown), the piston rod 47 engaging the plate or cam 42. To adjust the respective package width, there is an abutment device 49 (FIG. 7) displaceably mounted via a guidance 50 at an extension 51 being lockable in any desired position by means of a clamping lever 52. The abutment device 49 contains an angle or elbow 53 on which two compressed air cylinders 54 and 55 are fixed by nuts (not shown). At the piston rods 57 and 58, two stops 59 and 60 are disposed. On the guide bar 43, there is situated a fixed cam or stop 61 which is coacting with the stops. In the front portion of the horizontal leg of the elbow 53, a proximity switch 90 (FIGS. 13, 14) is mounted firmly by means of nuts 91. A clamping element 92 displaceably provided on the subjacent guide rod 43 may be clamped by means of a bolt 93, while another bolt 94 is adapted to laterally fix a sheet angle 95 at the clamping element 92. At one guide bar 62 which is displaceably supported in an (unillustrated) sleeve, there is provided a sliding element 63 which can be displaced via a piston rod 64 of a (non-illustrated) compressed air cylinder. The sleeve and cylinder are supported in a mounting 65 fixed to the support 18.

The cam means or entrainment device 41 and the abutment device 49 provided at the arm 51 may be adjusted in height. The arm 51 may be firmly connected to two sliding guides 66 (FIG. 2) being displaceably mounted on two guide bars 67. Adjustable stops 68 (FIG. 1) are provided as well. The lifting movement may be performed by a drive means, e.g. a compressed air cylinder 69 which is hinged at a holder 70 conveniently fitted at a square post 71. The piston rod 72 of the compressed air cylinder 69 is connected to a fork head 73 which engages pivotally the arm 51 by means of a bolt 74. The guide bars 67 are supported by elbows 76 secured to the square post 71, the upper portion of which is connected via a guide bar 77 with a holder 78 being screwed by means of bolt 79 on a plate 80 which is in solid connection with the yoke 18. The lower end of the square post 71 is connected via a guide bar 81 to a holder 82 carried by the yoke 18.

Figure 17:
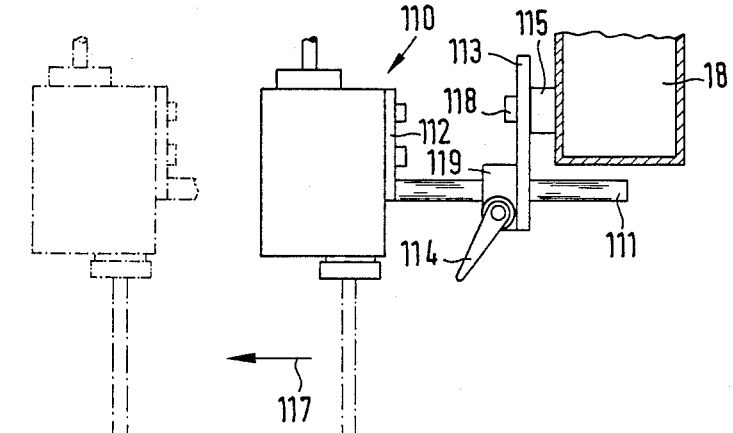
FIG. 17 is a schematic illustration of a device for the automatic operation of the feed movement of the support by means of a light barrier to start the production of a new package.
Figure 17:
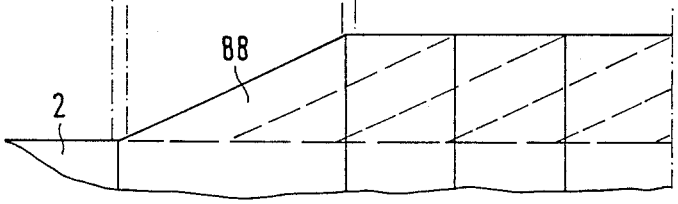
Figure 18:
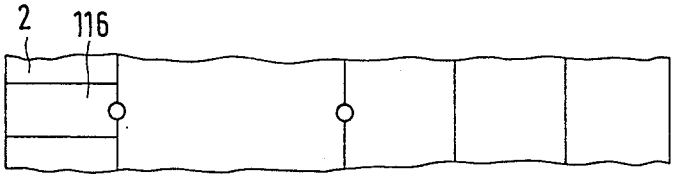
FIG. 18 is a plan view in detail.

FIGS. 17 and 18 show the elevational and plan view of a detail of the arrangement for an automatic advance movement of the support 18 from the end of a package 88 to the beginning of a new package. The advance movement is performed by the support 18, driven by threaded spindle 21. To control the advance movement, use can be made of a reflex light barrier 110 which is secured with the aid of the flap 112 to a guidance 111 displaceably disposed in a clamping piece 119 that is firmly connected to a plate 113. The guidance may be arrested by a clamping lever 114. The plate 113 may be firmly connected to the support 18 by means of the screws 118 and by a spacer 115. Moreover, in parallel to the longitudinal axle of the warping drum 2 and on the latter, there may be fitted a reflector sheet 116 to reflect the light beam of the reflex light barrier 110.

Figure 1:
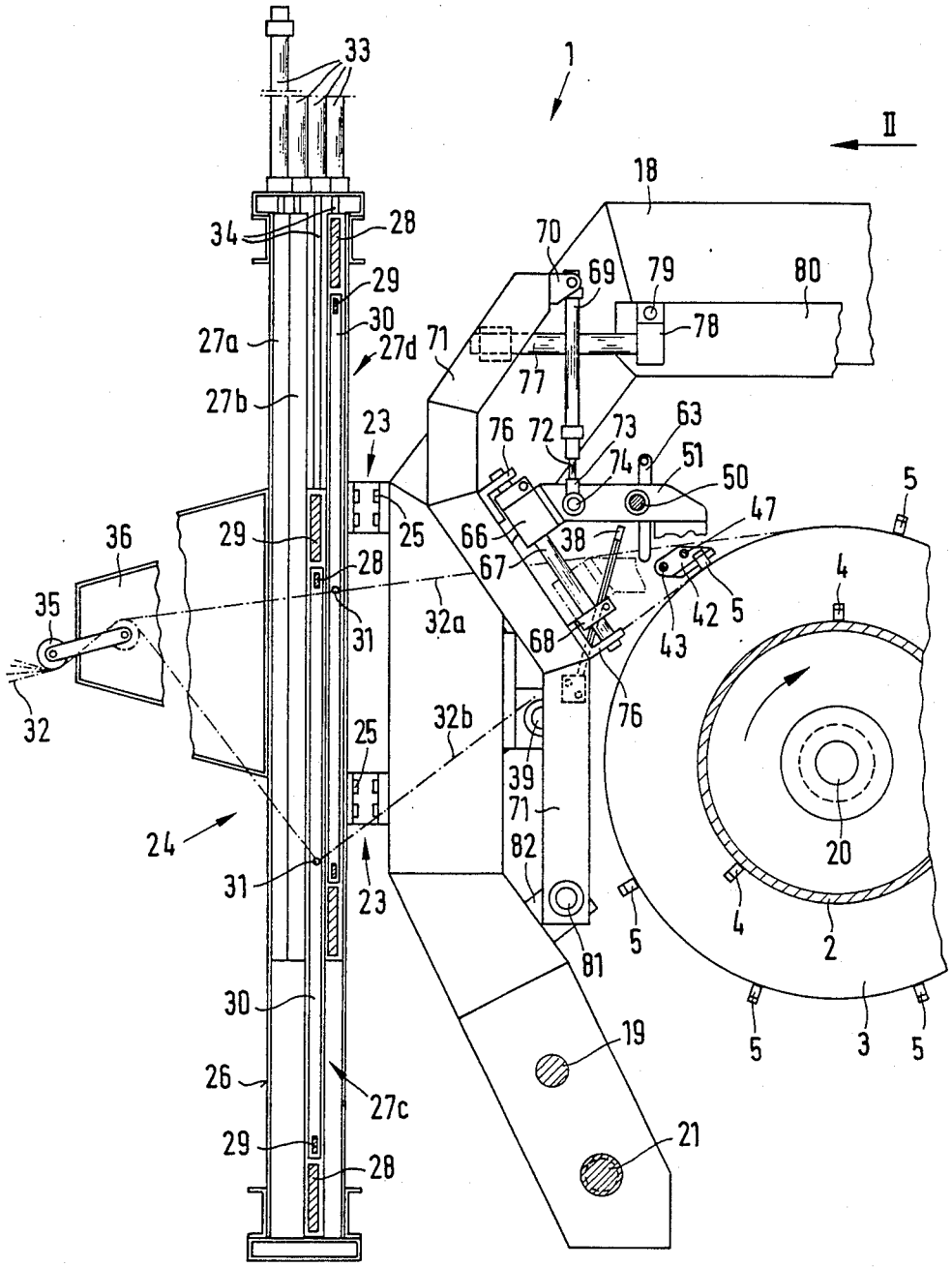
FIG. 1 is a schematic side view of the preferred embodiment of the warping apparatus of the invention.
Figure 2:
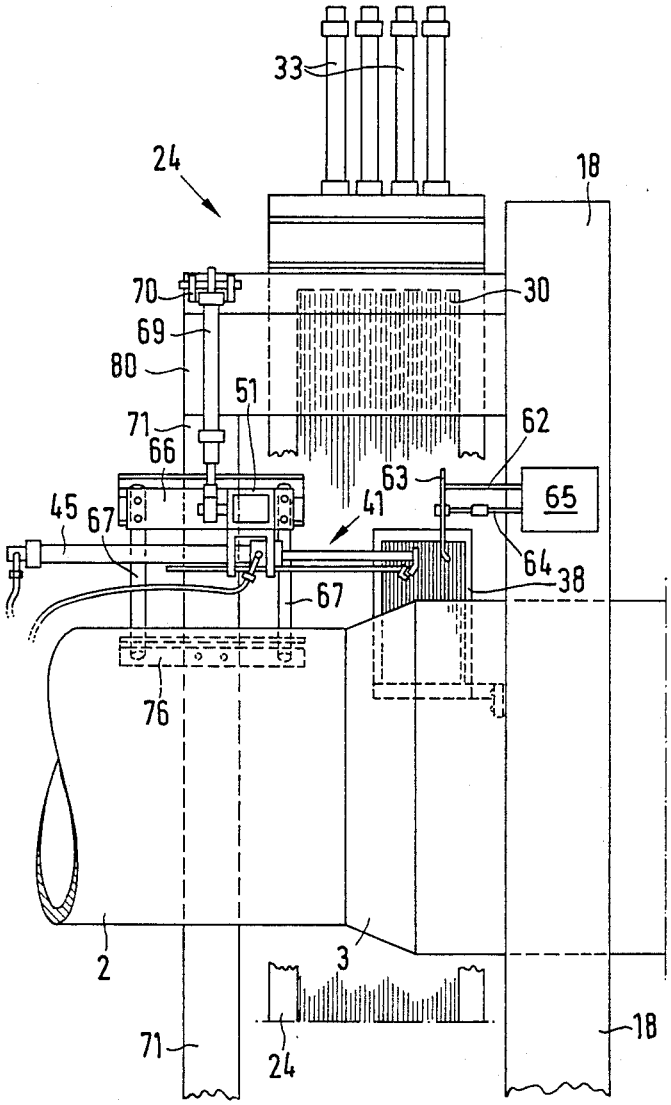
FIG. 2 is a detail and schematic, scaled down view of the warping apparatus, in the direction of arrow II of FIG. 1.
Figure 5:
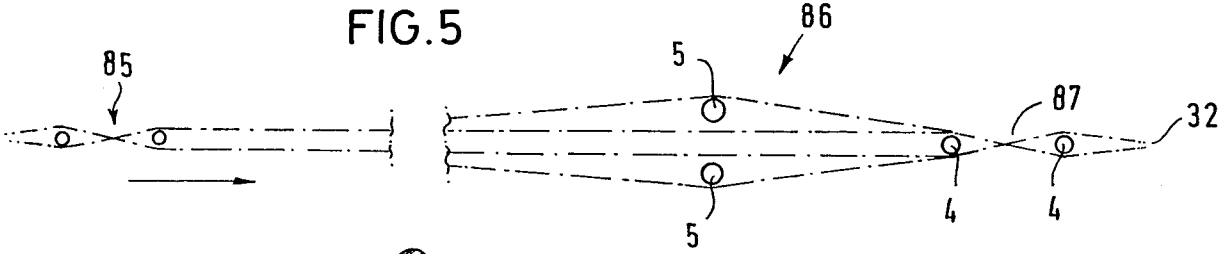
FIGS. 5 and 6 are meant to explain a yarn division or sizing division of the warp, the illustrations showing a schematic diagrammatic side view and a schematic perspective view.
Figure 6:
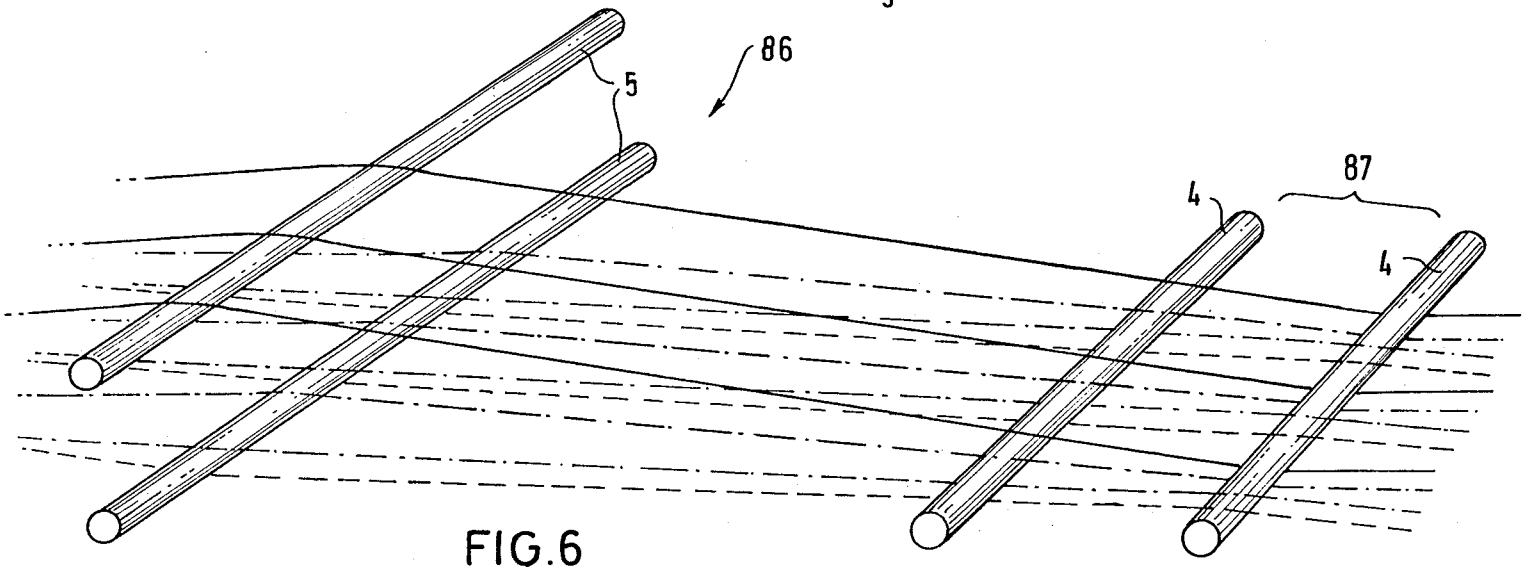

In operation, the yarn sheet 32 is fed from a creel via the device 35, to the heald frame 24. Referring to FIGS. 5 and 6, a yarn crossing 85 is formed by lowering shafts **27*b*, 27*d* with shafts 27*a*, 27*c* remaining in their upper position so as to produce a shed in the yarn sheet 32. FIG. 1 shows such a shed between two yarn sheets 32*a*, 32*b*. At this point the rotation of the warping drum 2 is interrupted and a lease rod 4 is inserted into the shed. Thereafter, the rotation of the warping drum 2 is started again and the relative positions of the shafts 27*a*, 27*c* and shafts 27*b*, 27*d* are reversed to produce another shed. Again, the rotation of the warping drum 2 is interrupted and another lease rod 4 is inserted into the new shed. Thereafter the shafts 27*a*, 27*c* are returned to their upper position and rotation of the warping drum 2 continues for a predetermined number of revolutions with backward feed movement of the support 18, after which the division 86** is formed.

The division 86 is formed by lowering shaft **27*a* with shafts 27*b*, *c*, *d* remaining in their upper positions so as to produce another shed in the yarn shed 32. At this point the rotation of the warping drum 2 is interrupted and a lease rod 5 is inserted into the shed. Thereafter the rotation of the warping drum 2 is started again and shafts 27*b*, 27*c* are lowered to join shaft 27*a* with shaft 27*d* remaining in its upper position to produce a further shed. Again, the rotation of the warping drum 2 is interrupted and another lease rod 5** is inserted into the new shed.

In order to produce the yarn crossing 87, rotation of the warping drum 2 is started again and shaft **27*b* is returned to its upper position to join shaft 27*d* with shafts 27*a*, 27*c* remaining in their lowered position to form another shed. Rotation of the warping drum 2 is interrupted and another lease rod 5 inserted into the new shed. Thereafter, the rotation of the warping drum 2 is recommenced and shafts 27*b*, 27*d* are lowered with shafts 27*a*, 27*c* being raised to their upper position to produce a further shed. Again, rotation of the warping drum 2 is interrupted and a further lease rod 5** is inserted into the further shed.

In FIGS. 5 and 6, the lease rods 5 at the division 86 are shown one above the other in order to show the yarn division more clearly.

After coming to the end of the package at its peripheral surface, the support 18 is advanced to the next starting position, with a transition portion of the closed yarn sheet 32 lying on the conical portion of the package, and the cycle starts again with the cords joined to the lease rods maintaining the leases in the packages already formed.

The shedding of the yarn sheet 32 is carried out in accordance with a specific program input by a (non-illustrated) electronic control which supplies pulses via magnetic valves to the compressed air cylinders 33. At the same time, the rotating warping drum 2 is stopped at specific angular positions by a (non-illustrated) compressed-air operated brake according to the program.

Figure 7:
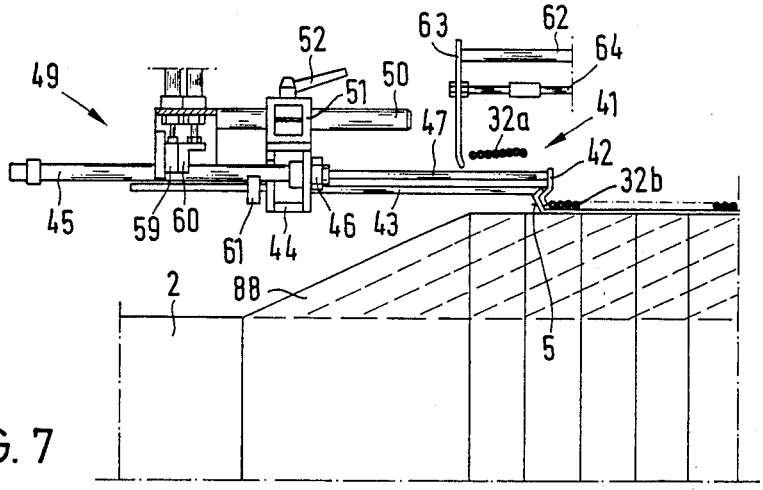
FIGS. 7, 8 and 9 are schematic views of one embodiment of the cam means to adjust the lease rods in longitudinal direction to the warping drum and in different working positions, FIGS. 10, 11 and 12 display schematically the production of a yarn crossing at the start of a warp in various positions, FIGS. 13 and 14 display schematic elevational and side views of the arrangement of a switch for the automatic actuation of a warping drum, FIGS. 15 and 16 shown an elevational and plan view of the device for guiding of the yarn sheet in the starting position so as to form a new package of predetermined length, while the yarn sheet must not overrun the lease rod.
Figure 8:
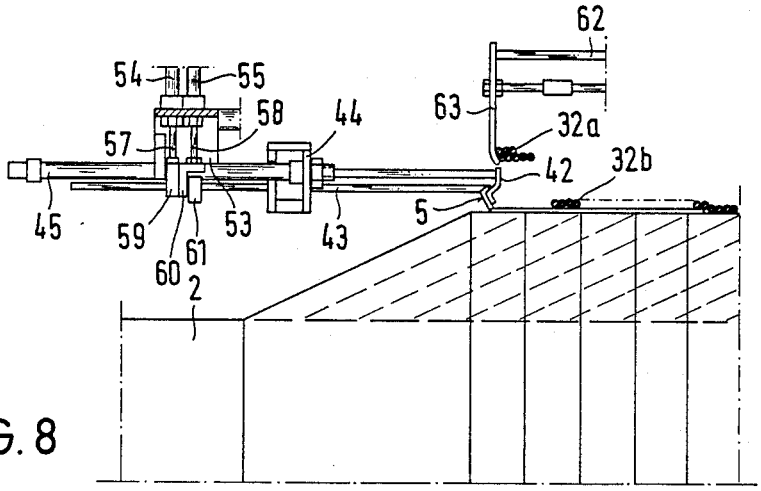
Figure 9:
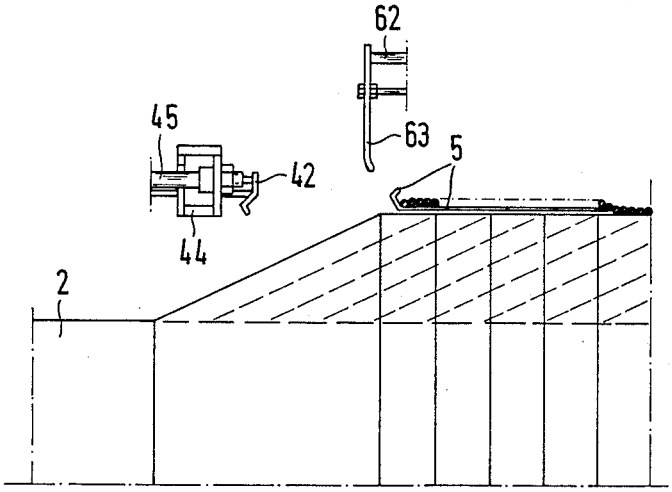

With the actuation of the shafts of the heald frame, the lease rods have to be displaced along the axis of the warping drum by way of the cam means or entrainment device 41. Responsive to the program, the warping drum 2 is stopped by a brake as soon as a lease rod 5 is present ahead of the cam or plate 42. By actuating the compressed air cylinder 45, the lease rod 5 is drawn corresponding to the adjusted width of a package 88 (FIG. 7) into the opened yarn sheet **32*a*,32*b*. An abutment means 49 is provided for setting the respective package width (FIGS. 7 to 9). As obvious from FIG. 8, the compressed air cylinder 45 has introduced by cam 42 the lease rod 5 into the opened yarn sheet 32*a*,32*b* in accordance with the adjusted package width. At the same time, the slide element 63 is operated to somewhat retain the upper half 32*a* of the opened yarn sheet to ensure that with another move of the warping drum 2, the yarn sheet is safely deposited behind the lease rod 5. The package width to be set will be fixed by the abutment or arresting means 49. With the advance stroke of the cam 42, the stops 59,60 are in the upper position (FIG. 7). During the return stroke, they are lowered so that the cam 61 abuts against the lowered stops 59,60 thus fixing the width of package 88. FIG. 9 shows the final position. Cam 42 is in the end position while the slide element 63 again occupies its initial position. The cam is released from the lease rod by rotating the warping drum. In case of FIG. 9, the upper half 32*a* of the yarn sheet has been wound over the lease rod 5. The warping drum 2 will be rotated to the next lease rod position. The compressed air cylinders 54,55** may be activated conveniently by magnetic valves which are controlled by the electronic control.

Figure 10:
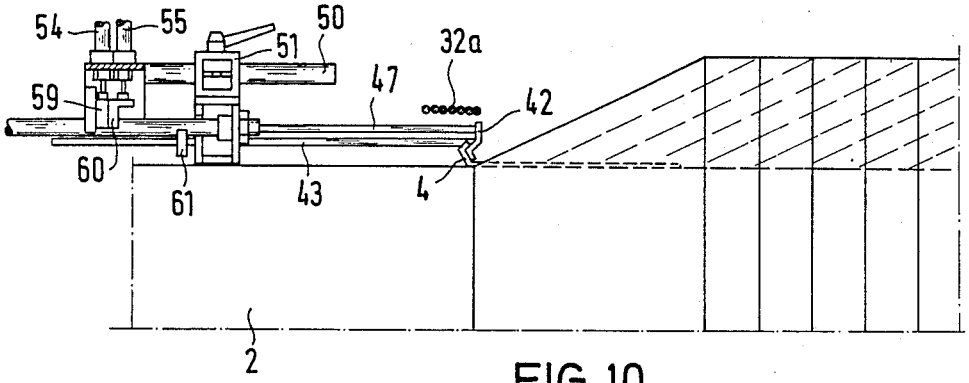
Figure 11:
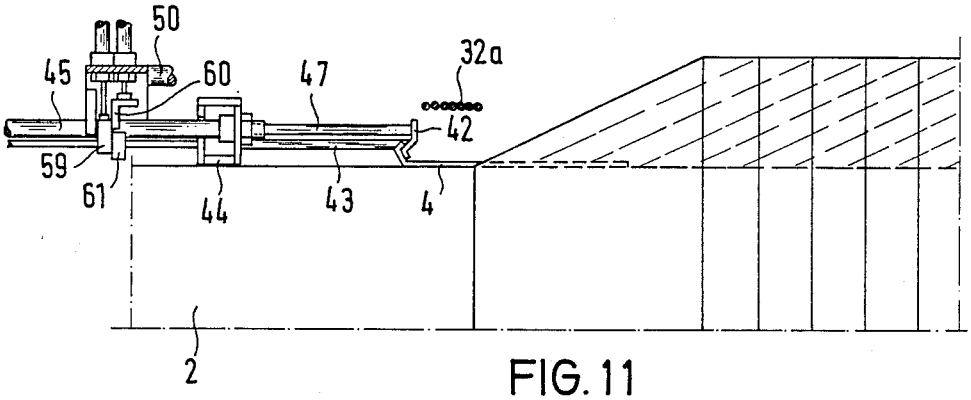
Figure 12:
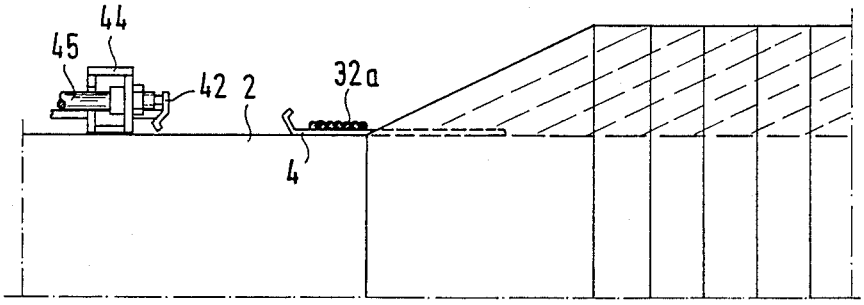

FIGS. 10 to 12 show the production of a yarn crossing at the beginning of a warp, the cam means 41 and the stop means 49 being lowered from above the extension 51 to the circumference of the cylindrical warping drum 2.

In the automatic performance, the yarn crossing is prepared at the beginning of the warp and after the yarn crossing at the end of the preceding package in the upper position. The lower yarn crossing at the start of the warp directly at the circumference of the cylindrical warping drum 2 is formed as described above, with the aid of the cam means 41. FIG. 10 shows the first step in view of the preparation of the lower yarn crossing, cam 42 being moved into the opened yarn sheet **32*a*,32*b***.

FIG. 11 shows the second step in which the lease rod 4 is drawn through the opened yarn sheet **32*a*,32*b* by way of the cam means 41. The displacement of the lease rod 4 is limited only by stop 59. The stop 60 remains in its upper position. Cam 61 will be now arrested by stop 59, so that the lease rod 4 is extracted along the adjusted package width. The upper half 32***a* of the yarn sheet 32 may now safely rest on lease rod 4. The illustration shown in FIG. 12 corresponds to the final position shown in FIG. 9. The preparation of a yarn crossing at the beginning of a warp requires two lease rods 4. As for the second lease rod, the operational steps disclosed in connection with the first lease rod are applicable as well. Upon preparation of the lower yarn crossing, the cam means 41 is moved automatically to the upper position by the extension 51 and by the compressed air cylinder 69. A new run-up of drum 2 according to the adjusted warping speed begins, and the next package can be warped. Upon reaching the adjusted number of meters, the warping drum 2 is braked. The program for the provided piece lengths of the package comprising the sizing divisions and the upper yarn crossings may be started again.

Figure 13:
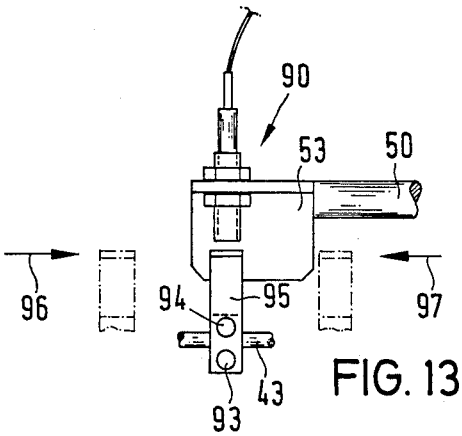
Figure 14:
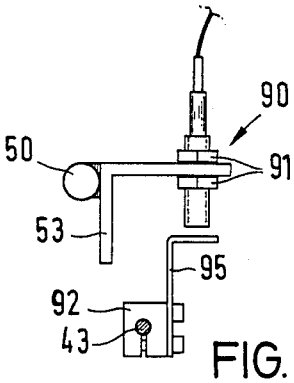

The rotation of the warping drum 2 is started conveniently automatically with the use of the proximity switch 90 (FIGS. 13,14). The guide rod 43 extends parallel to the piston rod 47 to perform the same lifting movements. With the advance stroke in direction of arrow 96, a switching will take place, but the pulse is blocked by a hold-off circuit. With the return stroke in direction of arrow 97, a switching is performed. The pulse is inputted by the electronic system and the warping drum 2 will be restarted.

Upon termination of the program at the peripheral surface of the finished package 88, by turning the warping drum 2, the closed yarn sheet 32 is mioved to the next starting position, i.e. via the conical portion of the package 88 to the diameter of the cylindrical drum 2. During this operation, the yarn sheet 32 must not slip along the conical end of the finished package 88 and must not overrun the two lower lease rods 4. An extra lease rod 5 may be used to prevent such slippage due to the slide 101 (FIGS. 15, 16), the yarn sheet 32 is pressed aside sufficiently so that lease rod 4 is not subjected to overrunning. Upon termination of a package 88, the advance movement of the support 18 is performed automatically in the direction of arrow 117 (FIG. 17). As long as the light beam of the reflex light barrier 110 is striking on the yarn of the package, the advance movement will not be interrupted. As soon as the light beam impinges on the sheet 116 (FIG. 18), the reflex light barrier 110 will be switched and the advance movement is interrupted (dot-lined illustration). As a result, the initial position for the preparation of the next package is reached. This operation is repeated from package to package, the exact positioning of the successive packages being performed at the same time.

Upon termination of the program at the peripheral surface of the finished package 88, by turning the warping drum 2, the closed yarn sheet 32 is moved to the next starting position, i.e. via the conical portion of the package 88 to the diameter of the cylindrical drum 2. During this operation, the yarn sheet 32 must not overrun the two lower lease rods 4. Therefore, a sliding means 100 (FIG. 15) is provided between the warping drum 2 and the warping reed 38 to deviate the yarn sheet 32 so that a lease rod 4, when passing by, is not overrun by the yarn sheet 32.

The sliding means 100 substantially consists of a slide 101, firmly connected via a fork head 102 to the piston rod 103 of a compressed air cylinder 105 disposed in a holder 104, mounted at the support 18 by means of a reinforcing plate 106. The slide 101 may be provided displaceably in a groove 107 of the mounting 81, its upper end being guided in a rail 108 which is firmly connected to the frame of the warping reed 38. The operation of the compressed air cylinder 105 may be performed by means of a magnetic valve with the aid of the program control means. Due to the slide 101, the yarn sheet 32 is pressed aside sufficiently so that lease rod 4 is not subjected to overrunning.

Moreover, in parallel to the longitudinal axle of the warping drum 2 and on the latter, there may be fitted a reflector sheet 116 to reflect the light beam of the reflex light barrier 110. Upon termination of a package 88, an advance or feed movement is performed automatically in the direction of arrow 117. As long as the light beam of the reflex light barrier 110 is striking on the yarn of the package, the advance movement will not be interrupted. As soon as the light beam impinges on the sheet 116, the reflex light barrier 110 will be switched and the advance movement is interrupted (dot-lined illustration). As a result, the initial position for the preparation of the next package is reached. This operation is repeated from package to package, the exact positioning of the successive packages being performed at the same time.

I claim:

1. Apparatus for the production of short warps, particularly for cloth designs in multicolor weaving, comprising means for successively winding up yarns of different colors upon a drum, means for selectively intermittently rotating said drum, said drum having a cylindrical portion and a conical start portion, means mounting lease rods for displaceable movement along the drum axis, a support, means for supplying a yarn sheet to the drum, means mounting said support for displaceable movement along the drum axis, heald frame means carried by said support for producing yarn sheds from the yarn, the improvement characterized by first and second lease rods operative respectively prior to and after a first yarn shed by said heald frame means to maintain a first yarn crossing therebetween formed by first and second yarn sheets, said heald frame means being further operative to divide said first and second yarn sheets into respective first and second pairs of yarn divisions, third and fourth lease rods operative after the division of the first and second yarn sheets and respectively positioned between the first and second pairs of yarn divisions, means for selectively displacing said first through fourth lease rods to maintain the first yarn crossing of the first and second yarn sheets and the first and second pairs of yarn divisions from the first and second yarn sheets; and control means for coordinating the operation of said first through fourth lease rods, said heald frame means and the intermittent rotation of said drum to produce said first and second yarn sheets, said first yarn crossing and the first and second pairs of yarn divisions.

2. The apparatus as defined in claim 1 wherein said heald frame means includes a plurality of shafts which are selectively displaceable to obtain yarn division, and means for carrying selective groups of yarn by each shaft.

3. The apparatus as defined in claim 1 wherein said heald frame means includes a plurality of shafts which are selectively displaceable along generally adjacent parallel paths to obtain yarn division, means for carrying selective groups of yarn by each shaft, and individual means for selectively displacing each shaft.

4. The apparatus as defined in claim 1 wherein said heald frame means includes a plurality of shafts which are selectively displaceable along generally adjacent parallel paths to obtain yarn division, means for carrying selective groups of yarn by each shaft, individual means for selectively displacing each shaft, and means for adjusting the length of travel of each shaft.

5. The apparatus as defined in any one of claims 1 through 4 wherein said lease rod displacing means includes cam means carried by said support for operating said lease rods, said cam means including a cam adapted to selectively engage said lease rods, said cams being carried by a piston rod of a fluid cylinder, said piston rod being disposed for movement generally parallel to the movement of said lease rods, means for effecting selected movement of said piston rod to move selected lease rods through said cam, and abutment means for limiting the stroke of said piston rod.

6. The apparatus as defined in claim 5 including means for adjustably displacing the position of said abutment means in the direction of piston rod travel, said abutment means being mounted for displacement along an extension carried by said support, and the extension being disposed generally parallel to said piston rod.

7. The apparatus as defined in claim 6 including means for mounting said extension for sliding movement relative to said support, and means for selectively adjusting the position of said extension relative to said support.

8. The apparatus as defined in claim 6 including means for mounting said extension for sliding movement relative to said support, said last-mentioned sliding mounting means being guide bars along which said extension slides, and means for selectively adjusting the position of said extension relative to said guide bars.

9. The apparatus as defined in claim 6 including means for mounting said extension for sliding movement relative to said support, said sliding mounting means including a guide bar, shifting means connected to said extension for moving said extension along said guide bar and means for limiting the sliding movement of said extension along said guide bar.

10. The apparatus as defined in claim 6 including a proximity switch for sensing drum rotation, said proximity switch being carried by said abutment means, and an adjustment pulse generator for said proximity switch carried by said guide bar.

11. The apparatus as defined in any one of claims 1 through 4 wherein said lease rod displacing means includes cam means carried by said support for operating said lease rods, said cam means including a cam adapted to selectively engage said lease rods, said cam being carried by a piston rod of a fluid cylinder, said piston rod being disposed for movement generally parallel to the movement of said lease rods, means for effecting selected movement of said piston rod to move selected lense rods through said cam, abutment means for limiting the stroke of said piston rod, a guide bar disposed generally parallel to said piston rod, said guide bar having one end fixed to said cam, another end of said guide bar being mounted for sliding movement in a holder, and said holder being carried by said support.

12. The apparatus as defined in claim 11 wherein said abutment means includes a pair of abutment members each being movable by a rod of a fluid piston into a position in general alignment with said guide bar, and an abutment cam carried by said guide bar for selectively contacting said abutment members.

13. The apparatus as defined in any one of claims 1 through 4 including means for moving the yarn sheet in an axial direction relative to the drum to prevent yarn sheet overrun.

14. The apparatus as defined in claim 13 including means for mounting the yarn sheet moving means for sliding movement.

15. The apparatus as defined in claim 14 including a groove defining a guide for said yarn sheet moving means, and a piston-cylinder unit for moving said yarn sheet moving means.

* * * * *